United States Patent [19]

Ohara et al.

[11] Patent Number: 4,700,769

[45] Date of Patent: Oct. 20, 1987

[54] CASTING APPARATUS FOR TITANIUM OR TITANIUM ALLOY

[75] Inventors: Isao Ohara, Toyonaka; Seizo Nakamura, Osaka, both of Japan

[73] Assignee: Ohara Co., Ltd., Osaka, Japan

[21] Appl. No.: 746,101

[22] Filed: Jun. 18, 1985

[51] Int. Cl.[4] ..... B22D 27/02

[52] U.S. Cl. ..... 164/514; 164/138; 164/289; 164/286

[58] Field of Search ..... 164/48, 250.1, 492–495, 164/512–514, 114, 286, 287, 289, 138, 515

[56] References Cited

U.S. PATENT DOCUMENTS

| | | | |
|---|---|---|---|
| 1,015,819 | 1/1912 | McManus, Jr. | 164/514 |
| 3,005,246 | 10/1961 | Murphy et al. | 164/495 |
| 3,476,171 | 11/1969 | Stark et al. | 164/495 |
| 4,254,817 | 3/1981 | Kidowaki et al. | 164/514 |
| 4,280,551 | 7/1981 | Ohara | 164/287 |

FOREIGN PATENT DOCUMENTS

| | | | |
|---|---|---|---|
| 2500521 | 12/1975 | Fed. Rep. of Germany | 164/495 |
| 3207170 | 11/1982 | Fed. Rep. of Germany | 164/138 |
| 40-15642 | 7/1965 | Japan | 164/495 |
| 57-91839 | 6/1982 | Japan | 164/138 |
| 58-132344 | 8/1983 | Japan | 164/495 |

OTHER PUBLICATIONS

Lang, R. M. et al., "Evaluation of Mold Materials for Ti Castings", *Trans. of the Amer. Foundryman's Soc.*, vol. 61, May 4–8, 1953, pp. 540–545.

*Primary Examiner*—Nicholas P. Godici
*Assistant Examiner*—Richard K. Seidel
*Attorney, Agent, or Firm*—Armstrong, Nikaido, Marmelstein & Kubovcik

[57] ABSTRACT

Improved casting of titanum or alloy of titanium is obtained by using a crucible and a mold made of high-purity magnesium oxide and/or zirconium oxide. It is also possible for only the interior portion of the crucible to be made of such high-purity material, or for the mold to be made of copper or an alloy of copper. The mold and crucible can be used in a centrifugal-type casting machine or a compression-type casting machine. In either machine, discharge vents must be provided in the mold to connect the casting chamber with the outer atmosphere. An argon electric arc generated between a pivotable, tiltable cathode and an anode may be used for melting the titanium in the crucible. A high-frequency electric current can also be used to melt the titanium. By using the above apparatus, it is possible to obtain castings which are dimensionally accurate and do not have an external layer of fragile metal oxide or rough cavities.

14 Claims, 23 Drawing Figures

205
204
204

206
205

207
206

208
207

2
201
208

209
207

210
209

208
210

2
201
208
210

CASTING APPARATUS FOR TITANIUM OR TITANIUM ALLOY

BACKGROUND OF THE INVENTION

Titanium has been widely used, for example, in aircraft, spacecraft, and chemical plants, because of its lightness, great mechanical strength and superior corrosion resistance. Since titanium parts for the above uses are mostly large, they can be produced by methods other than casting, for example, by forging. However, smaller parts, in particular those with complicated shapes such as prosthetic appliances, cannot be produced by methods other than casting.

When cast, an ingot of titanium or alloy of titanium must be speedily and efficiently melted. Since titanium has a high melting point of about 1,700° C. and is very reactive at high temperatures, its melting and casting have presented heretofore unsolved problems with respect to the crucible and mold that can be used. It has been impossible to cast such particularly small parts with complicated shapes from titanium or alloys thereof because cavities are produced in the cast product, and the molten metal does not adequately fill the casting chamber of the mold. For example, if a crucible made of silica and alumina is used for melting titanium, the molten titanium readily reacts with silica ($SiO_2$) or alumina ($Al_2O_3$) to erode the crucible. In addition, titanium becomes oxidized when it comes into contact with the surface of the crucible, resulting in the formation of a fragile layer of titanium oxide ($TiO_2$) on the surface of the titanium. When this titanium which contains titanium oxide impurities is cast, fragile portions are formed in the cast product.

Another disadvantage in the casting of titanium or alloys thereof is that certain properties of the mold, such as its corrosion resistance and heat resistance, are affected by the contact with molten titanium. For example, conventional molds made of high temperature materials such as phosphate, ethyl silicate and amorphous silicate are inevitably affected by contact with molten titanium and, as a result, a rough skin is produced on the surface of the cast product. This rough surface makes casting unsuitable for producing prosthetic appliances and other products to be used in an oral cavity.

In the casting of particularly small parts such as prosthetic appliances, the small space within the casting chamber of the mold makes it difficult to rapidly discharge air and gases from the casting chamber in order to reduce the build-up of air pressure therein and prevent molten titanium from flowing out. Furthermore, titanium has a high melting point of 1,720° C., whereas the mold is held at relatively low temperatures (20° to 600° C.) in the casting process in order to prevent the formation of rough skins on the cast product. Thus, there is a remarkably large difference between the temperature of the molten titanium and the temperature of the mold (which difference is about 1,100° to 1,700° C.). Thus, the time between the start of casting of molten titanium to its solidification in the mold is remarkably short, often causing insufficient casting. The molten titanium is solidified before it is uniformly distributed through the inside of the mold, in particular in the depth of the mold, and the shape of the cast product does not correspond accurately to the shape of the mold.

SUMMARY OF THE INVENTION

It is an object of the present invention to provide an apparatus for casting titanium or alloys of titanium whereby particularly small parts such as prosthetic appliances can be produced without rough skins being formed on the surface of the cast product and without inaccuracies in its shape due to insufficient casting.

DETAILED DESCRIPTION OF THE INVENTION

A preferred embodiment of a casting apparatus for titanium or alloys of titanium according to the present invention is a centrifugal type casting machine comprising: (1) a crucible provided in a crucible-fitting apparatus which is mounted on a rotary arm rotatable around a rotary shaft; said crucible being provided in connection with a melting means such as an argon-arc discharging apparatus; and (2) a mold mounted on a mold-receiving unit which is mounted on the same rotary arm. In this embodiment, molten titanium is cast from the crucible into the mold by the action of centrifugal force produced by rotating the rotary shaft by a suitable means. At least the interior portion of the crucible must be made of magnesium oxide and/or zirconium oxide to prevent molten titanium from reacting with the crucible. In addition, by making the mold of magnesium oxide and/or zirconium oxide and discharging air, gases and/or molten titanium from the casting chamber of the mold in the direction of the casting pressure, it is possible not only to prevent the generation of rough skins on the surface of a cast product, but also to prevent the formation of cavities on the surface of the cast product due to insufficient casting.

In a preferred embodiment of this apparatus, a cathode provided opposite to an anode which protrudes from inside the bottom of the crucible is pivotable to allow adjustment of the cathode so that an arc produced between the two electrodes in an atmosphere of argon gas fed around said cathode is uniformly distributed all over an ingot of titanium placed in the crucible, thereby uniformly and effectively melting the titanium.

Figure 1:
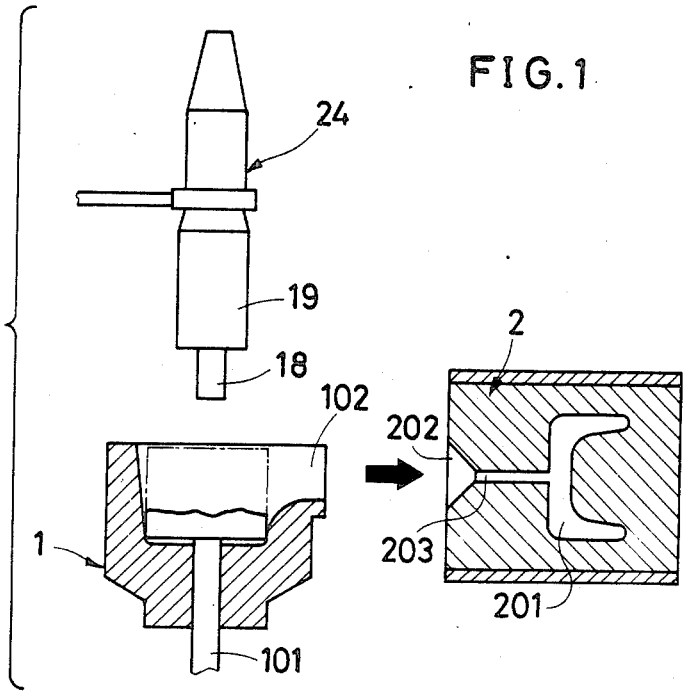
FIG. 1 is a simplified plan showing the arrangement of principal parts (crucible, anode, cathode and mold) of a casting apparatus for titanium or alloys of titanium according to the present invention.
Figure 3:
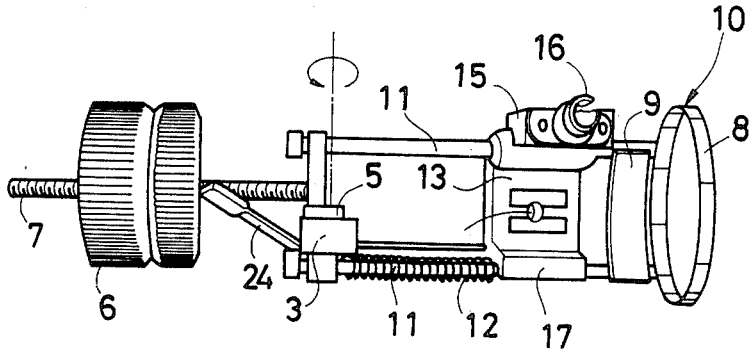
FIG. 3 is a plan (viewed from above) showing the principal parts of the casting apparatus shown in FIG. 2.
Figure 2:
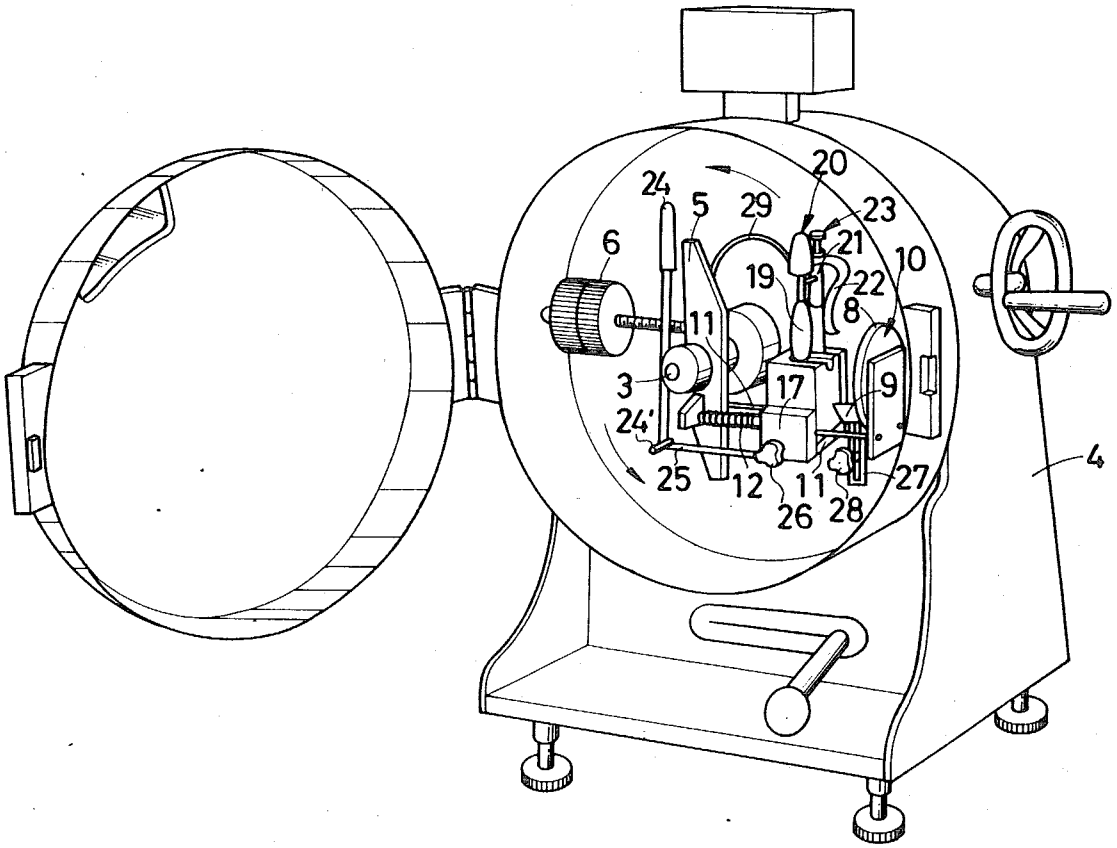
FIG. 2 is a simplified perspective view showing a preferred embodiment of a casting apparatus according to the present invention.

An embodiment of the casting apparatus of the present invention is described below in greater detail. The construction of the centrifugal casting machine may be according to U.S. Pat. No. 4,280,551 issued to the present applicant, or according to FIG. 2, or a combination of both. The construction in FIG. 2 comprises: a rotary shaft (3) provided so as to project from a body (4) and be rotatable by means of a bearing or the like provided inside said body (4); a rod member (7) (see FIG. 3) mounted on one side of the rotary shaft (3) directly or through a connecting plate (5) and provided with a balance weight (6) provided with threaded holes so that said balance weight can be adjusted along the length of the rod member (7); two parallel supporting rods (11, 11) mounted on each side of the rotary shaft (3) directly or through the connecting plate (5) and provided with a mold-receiving unit (10) consisting of a vertical dish-shaped support member (8) and a horizontal support member (9) positioned in front of said dish-shaped support member (8) for supporting a mold in such a manner that the height of the mold can be adjusted from the underside; a crucible-fitting apparatus (17) of almost a U-shape slidably mounted on the supporting rods (11, 11) and elastically forced away from the rotating shaft (3) by the action of springs (12) positioned on the supporting rods (11, 11) and provided with an opening through which an electrode (101) is inserted into a crucible (1) provided at the bottom of the crucible-fitting apparatus (17); a tube member (16) (see FIG. 3) provided vertically above the crucible-fitting apparatus (17) into which a fitting shaft (21) for an arc-generating apparatus (23) can be inserted; and arc-generating apparatus (23) provided with a fitting shaft (21) and spring clips (22, 22) pressing the outside wall of the tube member (16) (see FIG. 2); an argon-arc generating head (20) provided parallel to the arc-generating apparatus (23) and consisting of a cathode (18) (see FIG. 1) and a gas guide (19). Also in FIG. 2 a screw (26) for fixing a crucible, a leg plate (27) provided with a long hole for adjusting the height of the vertical dish-shaped support member (8), a screw (28) for stopping the leg plate (27), and a supply pipe (29) for argon gas are shown.

In operation, the mold (2) is placed on the horizontal support member (9) of the mold-receiving unit and the horizontal support member (9) is displaced upwardly to fix the mold (2) at the position where the upper end of the rear side of the mold (2) is stopped by the upper edge of the vertical dish-shaped support member (8) by screwing down the leg plate (27) provided under the horizontal support member (9). The crucible (1) is placed on the crucible-fitting apparatus (17) with the mouth portion of the crucible directed toward the mold and the anode (101) is inserted through the opening (14) into the bottom of the crucible (1). Then, an ingot of titanium placed in the crucible (1) is melted by an arc generated between the cathode (18) and the anode (101) in an atmosphere of argon gas fed from the circumference of the cathode (18). After the melting of an ingot of titanium is completed, the rotary shaft (3) is rotated by driving means such as a spring or a motor connected therewith, whereby molten titanium is poured into the mold from the crucible (1). The crucible-fitting apparatus (17) is displaced toward the rotary shaft (3) against the elastic force of the spring (12) by positioning the interim point (24') of a lever (24) near the rotary shaft (3) and pivotally connecting said interim point (24') of the lever (24) with a drag rod (25) fixedly mounted on the crucible-fitting apparatus (17) and operating the lever (24).

Figure 4:
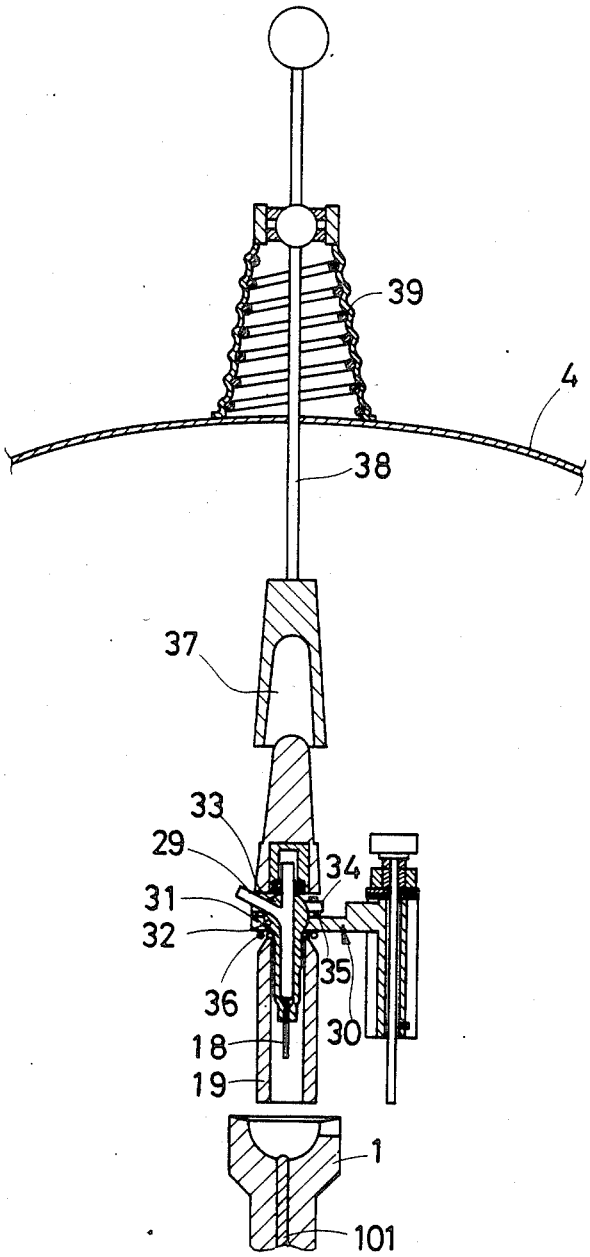
FIG. 4 is a sectional view showing a mechanism for rotating an electrode used is an argon-arc discharging apparatus.

In the casting apparatus of this invention, it is preferable that the cathode be pivotable. FIG. 4 shows a mechanism for pivotally adjusting the cathode (18) wherein the cathode is surrounded by a guide (19) for directing argon gas and is pivotally mounted on the center of the body of the guide. A supply pipe (29) for supplying the inside of the cover of the cathode with an inert gas such as argon is provided. A supporting member (30) is provided for fixing the cathode, said cathode being electrified through said supporting member (30). A supporting plate (31) mounted on the supporting member (30) is provided with a hole (32), into which the cathode (18) can be inserted. An expanded portion (33) provided at the interim portion of the body of the cathode is caught by an edge of said hole (32), and the supporting plate (31) is provided with a metal fitting (34) for pushing down the expanded portion (33) from the upside. The metal fitting (34) is provided with a hole for supporting said expanded portion (33) at the center thereof, the expanded portion (33) of the cathode being rotatably supported between the supporting plate (31), which is in the underside, and the metal fitting (34), which is in the upside, by fixing the metal fitting (34) by means of a vise (35) and a spring (36).

A pivotal supporting mechanism for the cathode is not limited to the above-described construction. Other constructions may be used. For example, a conventional universal-joint type construction may be used between the cathode (18) and the supporting member (30). In addition, the expanded portion (33) of said electrode (18) may be merely placed on the upper side of the supporting plate (31), or the cathode (18) placed on the supporting plate (31) may be stopped by means of suitable pressing means so that the cathode cannot be displaced.

If the cathode (18) is fixed, it is possible that only certain portions of an ingot are melted and different time periods are required for melting the adjacent portions of the ingot. Thus, certain portions of the ingot are overheated whereas other portions are insufficiently molten. If said expanded portion (33) of the cathode is rotatably supported between the metal fitting (34) and the supporting plate (31) as described above, an arc generated from the cathode (18) can be uniformly distributed all over the inside of the crucible (1) by rotating the cathode (18), thus resulting in a more uniform melting of the metals.

In addition to pivoting the cathode, it is particularly advantageous to adjust the tilt of the cathode. A tilting apparatus shown in FIG. 4 has a lower end structure engageable with the head portion of the cathode (18). For example, such lower end structure may be a hollow structure (37) into which the top portion of the cathode (18) can be engaged. The tilting apparatus is provided at its interim portion with a pivotal construction similar to that of the cathode (18) for mounting it on the wall or other parts of the casting apparatus. A supporting rod (38) for supporting the tilting apparatus, and a spring (39) are representative of such a tilting apparatus. The tilting apparatus can be moved up and down against the wall or other parts of the casting apparatus. For example, it can be moved downwardly to engage the head portion of the cathode (18) during the time when said cathode is rotated, thereby uniformly distributing an arc or the like generated from said cathode (18) all over the inside of the crucible (1). After metals contained in the crucible (1) are completely melted, the tilting apparatus is brought to the upward position and the casting apparatus is rotated around the rotary shaft (3) to produce a centrifugal force.

Figure 5:
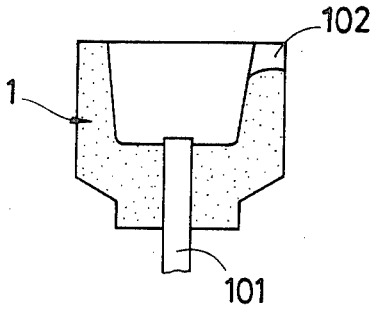
FIG. 5 is a sectional view showing the basic construction of a crucible according to the present invention.

According to the present invention, at least the interior portion of the crucible used must be made of high-purity magnesium oxide and/or zirconium oxide which have high melting points and do not react with molten titanium. FIG. 5 shows a crucible which is entirely made of magnesium oxide and/or zirconium oxide of high purity. The crucible has an anode (101), and an exit (102) from the crucible.

It is desirable that magnesium oxide and zirconium oxide be as pure as possible since impurities consisting of inorganic substances such a silica or alumina react with molten titanium. A purity of 95% or more, preferably 97% or more, is desired.

The following is an example of the preparation of a crucible for use in the casting apparatus of the present invention. 100 parts of magnesium oxide powders finely pulverized to a grade of 50 mesh or more are mixed with 3–30 parts of organic binders such as polyethylcellulose or inorganic binders such as magnesium chloride and magnesium sulfate. The resulting mixture is formed into a crucible and then heated at high temperatures of about 1,200°–1,400° C. to remove the binders, thereby producing a crucible made of magnesium oxide of high purity. A mixture of magnesium oxide and zirconium oxide, or zirconium oxide alone, is treated in the same manner for producing a crucible.

A crucible according to the present invention can efficiently melt pure titanium and alloys of titanium, in contrast to conventional crucibles, because it is made of magnesium oxide and/or zirconium oxide of high purity which have high melting points and do not tend to react with molten titanium.

Figure 6:
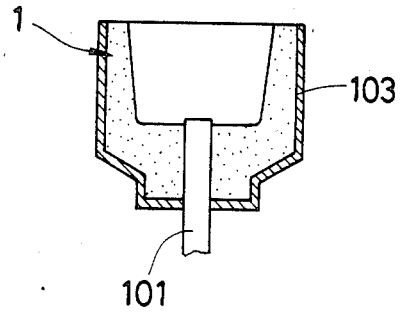
FIGS. 6–8 are sectional views showing other preferred embodiments of a crucible according to the present invention.
Figure 7:
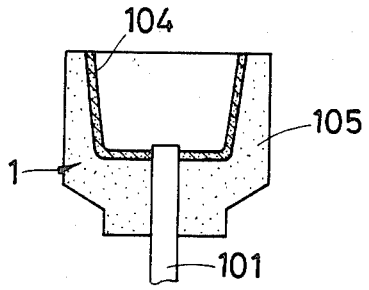

A crucible made of magnesium oxide and/or zirconium oxide of high purity may present a problem, however, in that it is fragile. Such a problem can be solved by reinforcing the periphery of the crucible with a frame member (103) made of metal plates such as steel plates as shown in FIG. 6, or by forming the interior portion (104) of the crucible of magnesium oxide and/or zirconium oxide of high purity of a desired thickness and covering the periphery of said interior portion (104) with a cover member (105) made of insulating materials having great mechanical strength and superior insulating property, such as ceramic materials, as shown in FIG. 7. Thus, the crucible may be reinforced while at the same time its cost is reduced because less magnesium oxide or zirconium oxide is used in its manufacture.

In another embodiment of a crucible according to this invention, only the interior portion (104) of the mold is made of magnesium oxide and/or zirconium oxide, and both a frame member (103) as shown in FIG. 6 and a cover member (105) as shown in FIG. 7 are used for reinforcing the crucible.

A further advantage in making only the interior portion (104) of magnesium oxide and/or zirconium oxide is that such portion can be conveniently removed and replaced if it is detachably provided inside the cover member (105) as shown in FIG. 7.

In another embodiment, the interior surface of a crucible made of copper is coated with magnesium oxide and/or zirconium oxide.

Figure 8:
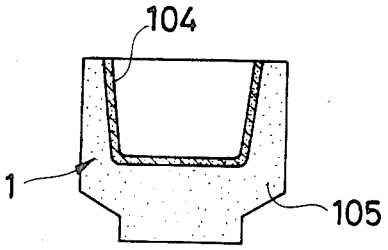

The crucibles according to this invention wherein at least the interior portion thereof is formed of burned magnesium oxide and/or zirconium oxide of high purity may be used not only with arc melting means, but also with high frequency melting means (as shown in FIG. 8).

The crucibles according to the present invention were tested in the casting of a titanium ingot of a given weight and were compared with crucibles made of magnesium oxide and/or zirconium oxide outside the scope of the present invention and other crucibles made of conventional materials. The results are shown in the following table.

| Lot No. | Crucible Purity (%) | Crucible Material | Melting Time sec | Molten State After 35 Seconds | Molten State After 48 to 49 Seconds | Condition of Crucible External Surface | Condition of Crucible Internal Surface |
|---|---|---|---|---|---|---|---|
| 1 | 75 | MgO | 50 | Molten titanium is splashed (when a titanium ingot loses its original shape). | Molten titanium is heavily splashed (directly before casting). | Cracks developed and crucible broken as a result of cracks. | Color changed to dark brown in thickness of 1 to 2 mm. |
| 2 | 90 | " | " | Molten titanium is slightly splashed. | Molten titanium is heavily splashed (directly before casting). | Cracks developed and crucible broken as a result of cracks. | Color changed to dark brown in thickness of 1 to 2 mm. |
| 3 | 94 | " | " | Molten titanium is slightly splashed. | Molten titanium is splashed. | Cracks developed and crucible broken as a result of cracks. | Color changed to dark brown in thickness of 1 to 2 mm. |
| 4 | 95 | " | " | Molten titanium is hardly splashed. | Molten titanium is slightly splashed. | Small cracks developed. | Color changed to light brown in thickness of about 1 mm. |
| 5 | 97 | " | " | Molten titanium is not splashed. | Molten titanium is not splashed. | No problem. | Hardly any change. |
| 6 | 98 | " | " | Molten titanium is not splashed. | Molten titanium is not splashed. | " | Hardly any change. |
| 7 | Internal surface 99.5 | " | " | Molten titanium is not splashed. | Molten titanium is not splashed. | " | Hardly any change. |
| 8 | Internal surface 99 | $ZrO_2$ | " | Molten titanium is not splashed. | Molten titanium is not splashed. | " | Hardly any change. |

-continued

| | | | | | | |
|---|---|---|---|---|---|---|
| 9 | $SiO_2 + Al_3O_2 \rightarrow SiO_2 + Al_2O_3$ | " | Molten titanium is heavily splashed. | Molten titanium is heavily splashed. | Cracks developed and crucible broken as a result of cracks. | Large amount of products of reaction with crucible remains. |

| Lot No. | Condition of Casting | Quantity of Metal | | | Evaluation |
|---|---|---|---|---|---|
| | | Molten Quantity | Casted Quantity | Casting Rate (%) | |
| 1 | Locally degenerated and fragile. | 25 g | 22 g | 88 | x |
| 2 | Locally degenerated and fragile. | " | " | " | x |
| 3 | Locally degenerated and fragile. | " | " | " | x |
| 4 | Hardly any change. | " | " | " | Δ |
| 5 | Hardly any change. | " | 23 g | 92 | o |
| 6 | Hardly any change | " | " | " | o |
| 7 | No change (original characteristics retained) | " | 24 g | 96 | ◎ |
| 8 | No change (original characteristics retained) | " | " | " | ◎ |
| 9 | Entirely fragile and completely degenerated. | " | 14 g | 56 | x |

x — Impossible to use for melting titanium
Δ — Possible to use for melting titanium
o — Good for melting titanium
◎ — Best for melting titanium Titanium ingot: Outside diameter of 20 mm, height of 17.5 mm, and weight of 25 g.

Melting method: Arc discharge in an atmosphere of argon.

Electric current: 150 A

Casting: All lots were cast in a casting chamber having the same shape and the same volume.

In Lot No. 9, where a crucible made of silica and alumina is used, heavy splashing of molten titanium is observed, the crucible and casting are particularly degenerated, and the cast quantity is small. It is obvious from these results that molten titanium reacts strongly with this type of crucible. In Lot Nos. 1 to 7, the effect of the purity of the magnesium oxide is tested. It is found that the crucible of Lot Nos. 1 to 3, made of magnesium oxide having a purity of 75 to 94%, are not satisfactory with respect to the condition of the molten titanium or alloys of titanium, the conditions of the crucible and the casting, and the quantity of cast metal. In Lot No. 4, where a crucible made of magnesium oxide having a purity of 95% is used, molten titanium is slightly splashed before it is cast, and the color of the interior portion of the crucible in Lot No. 4 is barely changed. In contrast, in Lot No. 3 where a crucible made of magnesium oxide having a purity of 94% is used, molten titanium is splashed, and the color of the internal surface of the crucible turns dark brown. In conclusion, although the difference in the purity of the magnesium oxide between Lot No. 3 and Lot No. 4 is small (94% vs 95%), only the crucible in Lot No. 4 (95% purity) can be used for melting titanium.

In addition, from Lot Nos. 5 and 6 it is seen that the casting results improve as the purity of the magnesium oxide used in the crucible increases. In Lot No. 7, where the interior portion alone of the crucible is formed of magnesium oxide having a purity of 99.5%, and in Lot No. 8 where the interior surface of the crucible is formed of zirconium oxide having a purity of 99%, excellent results are obtained, including a casting rate approaching 100%.

As described above, a crucible for melting titanium according to the present invention can easily be used to melt titanium or alloys thereof by an arc melting method or a high-frequency melting method, without producing any side reaction, contrary to the conventional wisdom that titanium or alloys of titanium cannot be melted due to their high melting points and reactivities. This is possible in the present invention because the entire crucible, or at least the interior portion of the crucible, is formed of magnesium oxide and/or zirconium oxide having a purity of 95% or more.

The lower mechanical strength of a crucible made of magnesium oxide and/or zirconium oxide can be easily compensated by covering the periphery of the crucible (1) with a metallic frame member (103) as shown in FIG. 6. In addition, the crucible can be reinforced, and simultaneously its cost can be reduced, by forming only the interior portion (104) of magnesium oxide and/or zirconium oxide of high purity, and forming a cover member (105) of materials having high mechanical strength, as shown in FIG. 7. Still further, the cover member (105) can be semi-permanently provided by detachably constructing the interior portion (104).

Crucibles according to this invention can be prepared by using, for example, magnesium sulfate or magnesium chloride as binders in the composition from which the crucibles are prepared, the magnesium sulfate or chloride being removed in the heating process or changed into magnesium oxide, giving a crucible containing no impurities.

The mold used in the present invention must be made of a material which is not affected by the high melting point of titanium and its high reactivity at high temperatures. When convention molds, such as those made of phosphate or ethyl silicate or amorphous silica, are used for casting titanium, problems are encountered because the molten titanium reacts strongly with the mold materials to erode the internal surface of the casting chamber or produce cracks in the mold, thereby making casting impossible. Even if casting is possible, the action of molten titanium upon mold materials leads to the formation of fragile titanium oxide on the surface of the casting and the formation of cavities as a result of the splashing of molten titanium which makes the surface of the casting rough. Thus, not only do the titanium oxide layer and the rough surface of the casting have to be cut off, thereby complicating the casting operation, but the dimensional accuracy of the casting is also consequently reduced.

In summary, according to the present invention, the action of molten titanium upon mold materials can be prevented by forming at least the interior portion of a mold of magnesium oxide and/or zirconium oxide of high purity. If silica is present in the magnesium oxide and/or zirconium oxide used as mold materials, the reaction of the mold materials with molten titanium increases proportionally with the silica content of the mold with a corresponding increase in the formation of rough skins and cavities on the surface of a casting. It is important that the magnesium oxide and/or zirconium oxide used as mold materials be of high purity. The most desirable degree of purity of the magnesium oxide and/or zirconium oxide if 99.5% or more. However, good casting results can be achieved even by using molds made of magnesium oxide and/or zirconium oxide having a purity of 95.0% or more, preferably 97.0% or more, depending on the casting temperatures.

A method for producing the above described mold is described as follows. 100 parts of magnesium oxide powders finely pulverized to a grade of about 50 mesh are mixed with 3–30 parts of organic binders such as polyethylcellulose or inorganic binders such as magnesium chloride and magnesium sulfate. The resulting mixture is burned at high temperatures of 1,200° to 1,400° C. to burn off the organic binders or change the magnesium chloride or magnesium sulfate into magnesium oxide, whereby a mold comprising only magnesium oxide as the main ingredient is obtained. The use of magnesium sulfate as a binder is preferred since magnesium sulfate is water soluble, hardens at temperatures of about 70° C., is easily mixed with magnesium oxide particles and therefore easily molded, and is completely decomposed and changed into magnesium oxide upon burning. Thus, it is preferable to use a combination of magnesium sulfate and magnesium oxide for mold materials.

Magnesium oxide contracts when it is sintered at high temperatures of 1,200° C. or more, and also contracts when the mold is cooled to temperatures of about 800° C. or less in the casting of titanium. On the other hand, titanium also contracts when it resolidifies. Thus, a titanium casting having improved dimensional accuracy can be obtained by forming an auxiliary model from a wax mold, which is a base for producing a mold, taking into consideration the contraction of the mold due to the sintering of magnesium oxide and the contraction of titanium due to its solidification in casting.

Figures 9A, 9B, 9C, 9D, 9E, 9F, 9G, 9H, 9I:
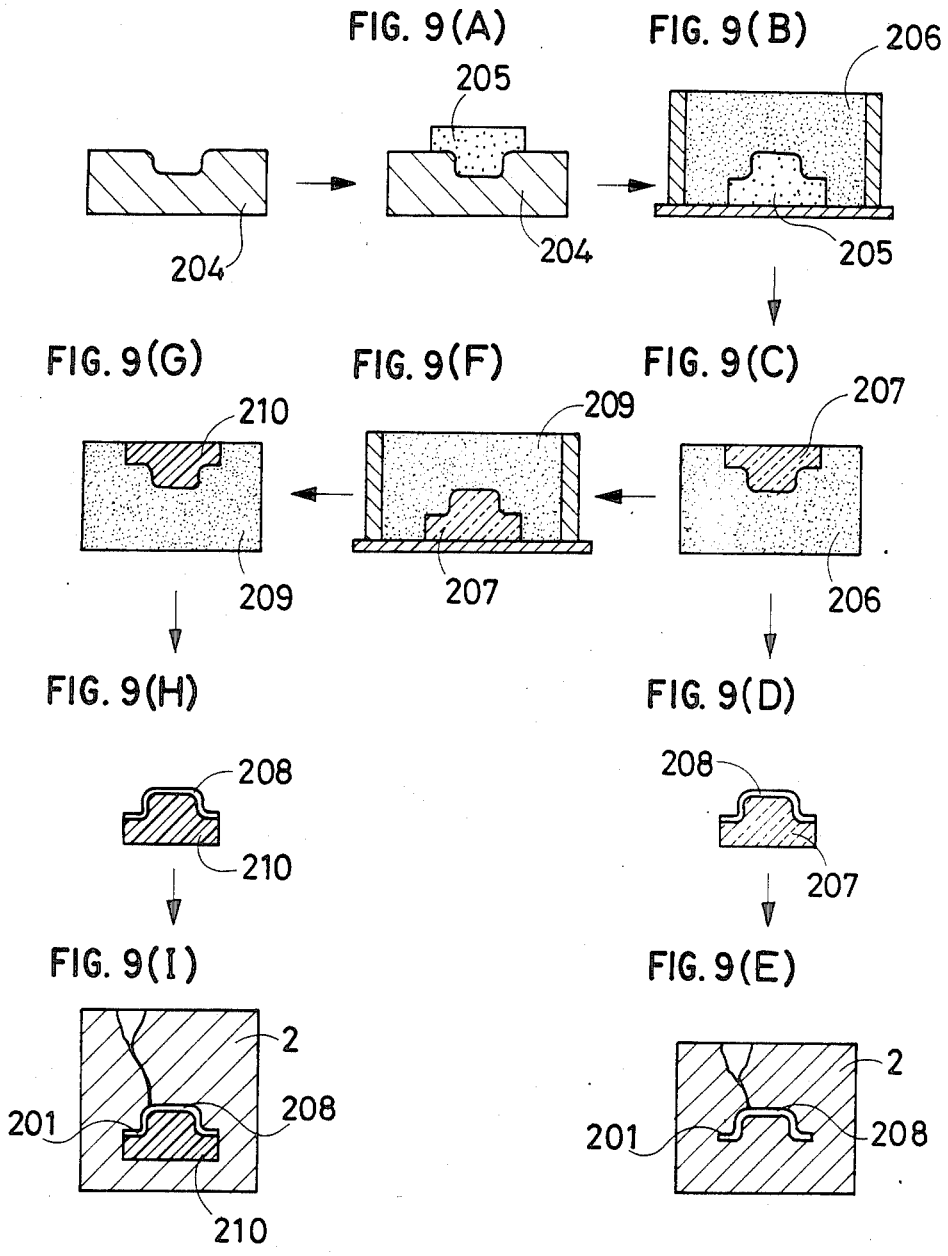
FIGS. 9A–I is a production drawing showing an example of a production process using a mold according to the present invention.

For example, in the casting of prosthetic appliances, as shown in FIG. 9, a gypsum model (205) is produced by process A on the basis of an oral impression (204), then an agar-agar model (206) is produced by process B followed by filling the interior portion of the agar-agar model (206) with various kinds of filling in process C to produce an auxiliary model (207) in the usual manner. In this process, the auxiliary model (207) is made of materials such as phosphate which expand when solidified, such expansion ratio being known. The size of the auxiliary model (207) is selected to be larger than that of the casting to be obtained after the contraction (about 2 to 10%) in order to compensate for the contraction due to the sintering of magnesium oxide and the contraction due to the solidification of titanium in the casting process.

To produce articles for which relatively lower accuracy is required, such as cast crowns, the auxiliary model (207) is coated with wax by process D and then the auxiliary model (207) is removed to produce a wax pattern (208) followed by burying the wax pattern (208) in mold materials (magnesium oxide and/or zirconium oxide) and then burning it by process E to obtain a mold (2).

To produce castings of higher accuracy such as metallic plates or implant denture, an agar-agar impression (209) is produced again on the basis of the auxiliary model (207) (see process F), the interior portion of the agar-agar impression (209) is filled with mold materials (magnesium oxide and/or zirconium oxide) by process G to produce a vice-auxiliary model (210), said vice-auxiliary model (210) is coated with wax by process H, and the resulting wax-coated vice-auxiliary model is buried in mold materials (magnesium oxide and/or zirconium oxide) again and then burnt to burn off wax, whereby a mold (2) having a cavity corresponding to the burnt off wax as a casting chamber (201) is formed. The above described mold materials (magnesium oxide and/or zirconium oxide) is used in the form of a paste consisting of a mixture of magnesium oxide and/or zirconium oxide, magnesium sulfate as a binder, and water. In processes E, G and I, an auxiliary model is buried in the mold materials of magnesium oxide and/or zirconium oxide, which are then dried naturally for 1 to 2 days, or dried by hot-water heating, or in a furnace, or by electromagnetic heating or other methods (such as heating for about 10 minutes at temperatures of 70° to 100° C.) in order to harden and burn them.

Figure 10:
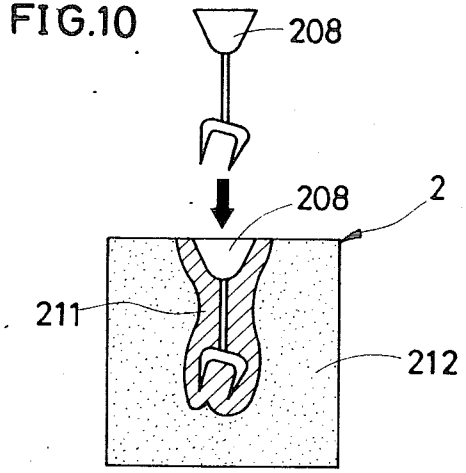

The present invention is characterized in that magnesium oxide and/or zirconium oxide of high purity are used for mold materials. However, a mold that is entirely made of mold materials of such high purity is expensive, and also has poor mechanical strength. According to this invention, it is possible to form only the internal surface of the casting chamber, which is the only part brought into direct contact with molten titanium, of materials of high purity. Other portions of the mold are formed of the same materials but of lower purity, or of other materials. For example, as shown in FIG. 10, the wax pattern (208), formed by coating an auxiliary model with wax and then removing the auxiliary model, is first buried in magnesium oxide and/or zirconium oxide of high purity (211) and then buried in magnesium oxide and/or zirconium oxide of lower purity (212), followed by drying in order to harden and burn the mold materials to form a mold in the same manner as described above.

The use of a mold according to the present invention can eliminate various problems due to the reaction of molten titanium with mold materials and can produce titanium products, in particular small parts with complicated shapes like prosthetic appliances, without loss of the original physical and chemical properties of titanium or alloys thereof and without producing cavities or rough skins on the surface of the cast article. In particular, the reaction of molten titanium with mold materials can be almost completely prevented by using magnesium oxide and/or zirconium oxide having a purity of 97.0% or more, whereby titanium castings are produced which do not need to have their surfaces subsequently shaved off to remove fragile oxide and rough cavities.

Figure 11:
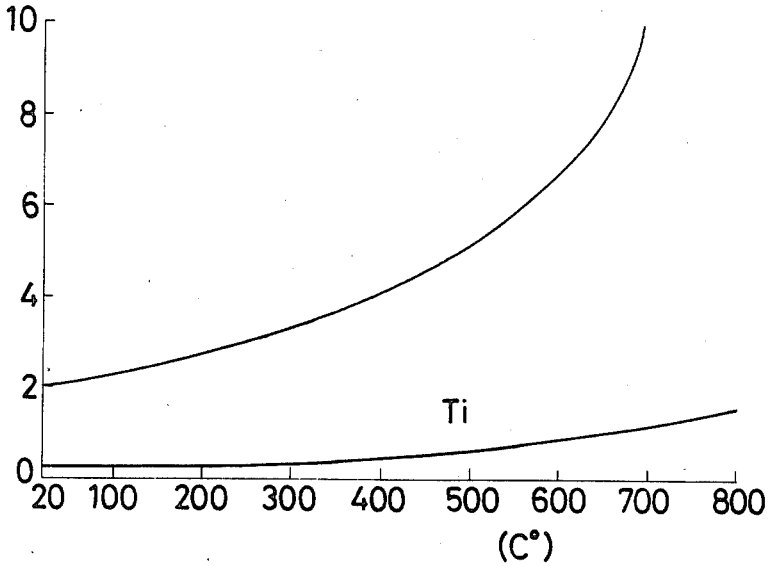
FIG. 11 is a graph showing the relationship between molding temperatures and solidification times of molten metals.

Furthermore, a preferred embodiment of a mold which can prevent incomplete casting is described as follows. Since titanium has a high melting point of 1,720° C. and a casting temperature in the range between room temperature (20° C.) and 600° C. is used in order to prevent the formation of rough skins and other defects, the temperature difference between molten titanium and the mold is remarkably large (1,100° to 1,700° C.) and, the solidification time is very short, much shorter than for silver alloys for example (FIG. 11). As a result, incomplete casting cannot be prevented by conventional methods such as by increasing the casting pressure or providing a passage into the casting chamber by the use of a spool line. In particular, insufficient casting due to the pressure of the air and gases trapped in the casting chamber where they are in a convection state cannot be eliminated.

Figure 12:
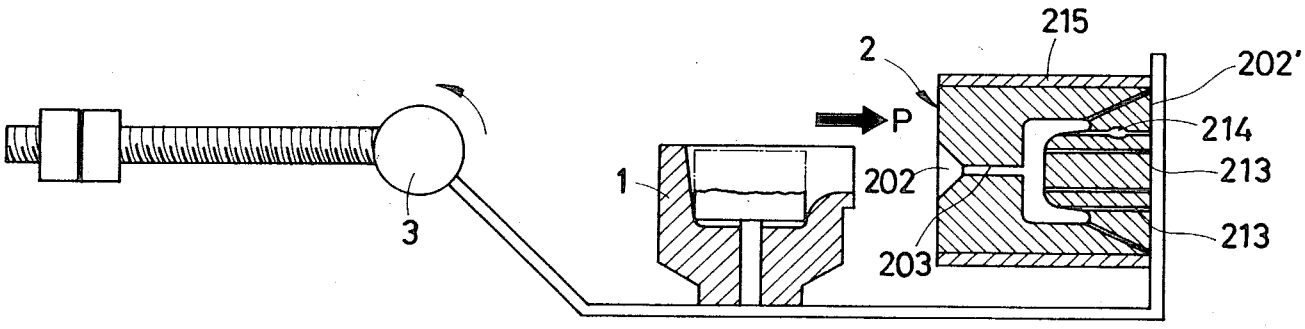
FIG. 12 is a simplified plan showing the casting process.

In a mold according to the present invention, the formation of cavities or defects on the surface of the cast product due to insufficient casting is prevented by discharging air and gases inducted into or already contained in the casting chamber in the same direction as the casting pressure. This mold is described with reference to a preferred embodiment as shown in FIG. 12. The direction P of the casting pressure means the direction of the centrifugal force exerted upon the mold (2). Air and gases contained in the casting chamber (201) can be instantly discharged out of the casting chamber through discharge vents (213) opening into said casting chamber (201) and arranged in parallel or inclined by, for example, 45° in relation to the direction P of the casting pressure. This instant discharge of air and gases allows molten titanium (which has a remarkably short solidification time of about 1 second) to be uniformly distributed all over the depths of the casting chamber (201). As a result, the casting pressure can be uniformly distributed all over the inside of the casting chamber, without having to increase this casting pressure excessively. By providing discharge vents in the mold, air and gases generated in the casting chamber can be smoothly discharged, but also the induction of air due to high casting pressures can be prevented. As a result, the formation of defects caused by gases generated from titanium or by air inducted into the casting chamber can be completely prevented.

Figure 13:
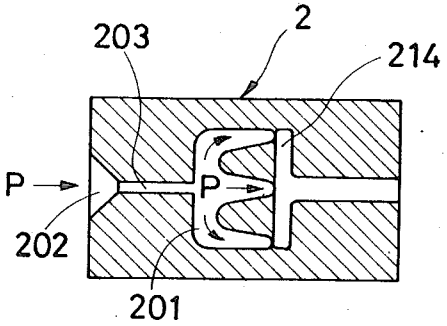
FIGS. 10 and 13 are sectional views showing other preferred embodiments of a mold according to the present invention.
Figure 14:
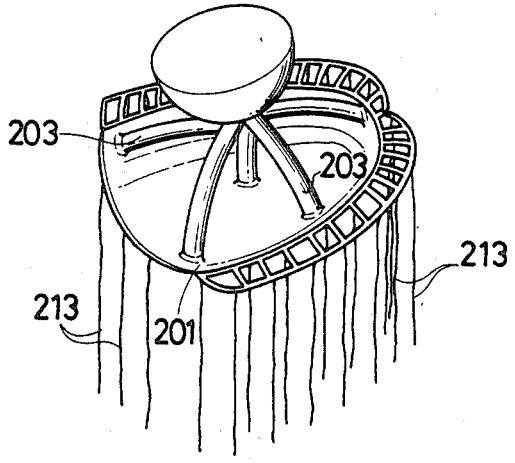
FIGS. 14 and 15 are perspective views showing casting chambers of different shapes.
Figure 15:
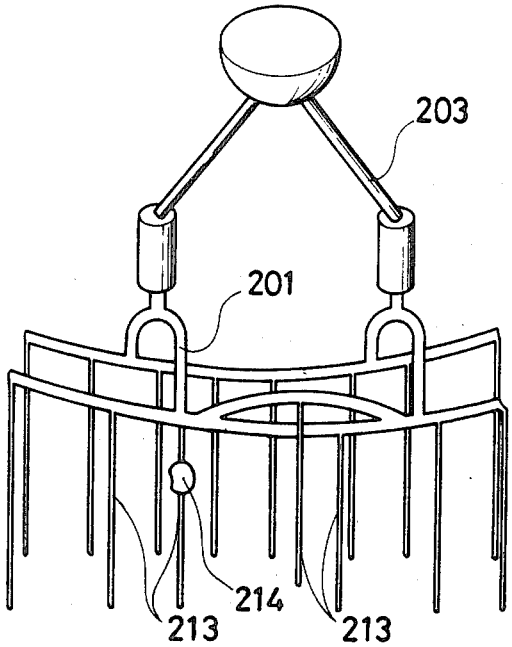

In addition to the discharge vents (213), well portions (214) may be provided at the interim position of said discharge vents (213) as shown in FIG. 12. Said well portions (214) may also be provided at the deepest ends of the casting chamber (210) extending in the direction of the casting pressure (arrow P' in FIG. 13). The well portions may be provided at the position of the discharge vents (213) in cases where there is a great risk of insufficient casting, as for example, where the deeper end of the casting chamber has a complicated shape, or the wall of the casting chamber is thick, as shown in FIGS. 14 and 15.

In the above-described centrifugal casting method, since the distance from the rotary shaft (3) to the casting inlet (202) of the mold (2) is smaller than the distance from said shaft (3) to the open end (202') of the mold, the circumferential speed of said open end (202') is larger than that of said casting inlet (202) (see FIG. 12). As a result, the pressure on the side of the open end (202') of the mold is higher than the pressure on the side of the casting inlet (202). This pressure differential contributes to the casting pressure.

In centrifugal casting, the discharge vents (213) are preferably formed parallel to the direction P of the casting pressure. In addition, some discharge vents (213) may be inclined at a given angle (as in FIG. 12) with the open end (202') of the vents positioned at an open end of a ring vessel (215) surrounding the mold. In this case, the operation of forming the discharge vents (213) by using extremely fine wires, for example synthetic resin wires such as nylon wires, can be done easily.

In compression casting, the discharge vents (213) are formed in the direction of the pressure difference.

In summary, air and gases can be discharged in the direction of the casting pressure by merely forming discharging vents parallel to the direction of the casting pressure, that is, the direction of centrifugal force in centrifugal casting, or the direction of the pressure difference in compression casting, or by forming well openings in the discharge vents, or by forming independent wells.

In another embodiment of the casting apparatus of this invention, a mold made entirely of copper or alloys thereof may be used. In such a mold, not only the internal surface of the casting chamber (201), but also the internal surface of the spool line (203), can be made flat and smooth. As a result, the flow of molten titanium is accelerated and the formation of cavities due to obstruction in the flow of molten titanium and inclusion of air in the surface of the titanium and the surface of the mold can be completely eliminated. Thus, the use of a mold made of copper or alloys thereof is highly effective for preventing the formation of cavities and defects due to insufficient casting, even at a high casting speed. This is because the internal surface of the spool line and the casting chamber is flat and smooth, and air is not adhered to the internal surface or contained in the chamber.

What is claimed is:

1. An apparatus for casting titanium or an alloy of titanium consisting essentially of (a) means for generating an argon electric arc, including an upper electrode and a lower electrode, the upper electrode including means for emitting argon from the periphery thereof and for directing the argon toward the lower electrode;

(b) a crucible positioned below the upper electrode, said crucible having (1) an interior portion for receiving the titanium or alloy of titanium, at least said interior portion of the crucible consisting essentially of a metal oxide having a purity of at least 95% selected from the group consisting of magnesium oxide and zirconium oxide, the upper end of the lower electrode protruding out of the bottom of said interior portion of the crucible;

(2) an exit for molten titanium or titanium alloy located in said interior portion;

(c) means for rotating said crucible about an axis; and (d) a mold consisting essentially of a metal oxide having a purity of at least 95% selected from the group consisting of magnesium oxide and zirconium oxide, positioned and arranged to rotate on the same axis of rotation and at the same speed as the crucible and to communicate with the exit of the crucible, said mold including a casting chamber for receiving molten metal flowing from the exit of the crucible as a result of centrifugal force generated when the crucible is rotated and further including discharge vents connecting the casting chamber with the outer atmosphere.

2. An apparatus for casting titanium or an alloy of titanium as in claim 1, wherein at least the interior portion of the crucible consists essentially of said metal oxide having a purity of at least 99.5%.

3. An apparatus for casting titanium or an alloy of titanium as in claim 2, wherein said crucible is reinforced by forming the interior portion thereof of metal oxide having a purity of at least 95% and covering the outer surface of the layer of metal oxide with a cover member consisting of insulating materials.

4. An apparatus for casting titanium or an alloy of titanium as in claim 2, wherein said crucible is reinforced by a frame member covering the periphery of the crucible, said frame member consisting of metallic plates.

5. An apparatus for casting titanium or an alloy of titanium as in claim 4, wherein said crucible is reinforced by forming the interior portion thereof of metal oxide having a purity of at least 95% and covering the outer surface of the layer of metal oxide with a cover member consisting of insulating materials.

6. An apparatus for casting titanium or an alloy of titanium as in claim 1, wherein said crucible is reinforced by a frame member covering the periphery of the crucuible, said frame member consisting of metallic plates.

7. An apparatus for casting titanium or an alloy of titanium as in claim 6, wherein said crucible is reinforced by forming the interior portion thereof of metal oxide having a purity of at least 95% and covering the outer surface of the layer of metal oxide with a cover member consisting of insulating materials.

8. An apparatus for casting titanium or an alloy of titanium as in claim 1, wherein said crucible is reinforced by forming the interior portion thereof of metal oxide having a purity of at least 95% and covering the outer surface of the layer of metal oxide with a cover member consisting of insulating materials.

9. An apparatus for casting titanium or an alloy of titanium as in claim 1, wherein said upper electrode is pivotably mounted.

10. An apparatus for casting titanium or an alloy of titanium as in claim 9, wherein said upper electrode is provided with an expanded portion, said expanded portion being pivotally supported.

11. An apparatus for casting titanium or an alloy of titanium as in claim 1, wherein said mold consists essentially of said metal oxide having a purity of at leaast 99.5%.

12. An apparatus for casting titanium or an alloy of titanium as in claim 1, wherein said discharge vents are formed in the direction of the casting pressure.

13. An apparatus for casting titanium or an alloy of titanium consisting essentially of (a) means for generating an argon electric arc, including an upper electrode and a lower electrode, the upper electrode including means for emitting argon from the periphery thereof and for directing the argon toward the lower electrode;

(b) a crucible positioned below the upper electrode, said crucible having (1) an interior portion for receiving the titanium or alloy of titanium, at least said interior portion of the crucible consisting essentially of a metal oxide having a purity of at least 95% selected from the group consisting of magnesium oxide and zirconium oxide, the upper end of the lower electrode being exposed at the bottom of said interior portion of the crucible;

(2) an exit for molten titanium or alloy of titanium located in said interior portion;

(c) means for rotating said crucible about an axis; and (d) a mold consisting of copper or an alloy of copper, positioned and arranged to rotate on the same axis of rotation and at the same speed as the crucible and to communicate with the exit of the crucible, said mold including a casting chamber for receiving molten metal flowing from the exit of the crucible as a result of centrifugal force generated when the crucible is rotated, and further including discharge vents connecting the casting chamber with the outer atmosphere.

14. An apparatus for casting titanium or an alloy of titanium consisting essentially of (a) means for using a high-frequency electric current to melt titanium or an alloy of titanium;

(b) a crucible having (1) an interior portion for receiving the titanium or alloy of titanium, at least said interior portion of the crucible consisting essentially of a metal oxide having a purity of at least 95% selected from the group consisting of magnesium oxide and zirconium oxide;

(2) an exit for molten titanium or titanium alloy located in said interior portion;

(c) means for rotating said crucible about an axis; and (d) a mold consisting essentially of a metal oxide having a purity of at least 95% selected from the group consisting of magnesium oxide and zirconium oxide, positioned and arranged to rotate on the same axis of rotation and at the same speed as the crucible and to communicate with the exit of the crucible, said mold including a casting chamber for receiving molten metal flowing from the exit of the crucible as a result of centrifugal force generated when the crucible is rotated and further including discharge vents connecting the casting chamber with the outer atmosphere.

* * * * *